US006728972B1

(12) United States Patent
Whitley

(10) Patent No.: US 6,728,972 B1
(45) Date of Patent: May 4, 2004

(54) HATS, HAT COMPONENTS, AND METHOD OF FORMING HATS

(76) Inventor: James M. Whitley, 2963 Morley Rd., Cleveland, OH (US) 44122

( * ) Notice: Subject to any disclaimer, the term of this patent is extended or adjusted under 35 U.S.C. 154(b) by 265 days.

(21) Appl. No.: 09/908,150

(22) Filed: Jul. 18, 2001

(51) Int. Cl.[7] ..... A42B 1/00
(52) U.S. Cl. ..... 2/175.1; 2/209.12
(58) Field of Search ..... 223/7; 493/938, 493/937; 2/202, 209.11, 209.12, 175.1

(56) References Cited

U.S. PATENT DOCUMENTS

| | | | | |
|---|---|---|---|---|
| 128,780 | A | 7/1872 | Battle | |
| 238,865 | A | 3/1881 | Davis | |
| 1,214,128 | A | 1/1917 | Brooks | |
| 1,368,864 | A | 2/1921 | Turner | |
| 1,714,100 | A | 5/1929 | Moeller | |
| 1,716,537 | A | 6/1929 | Acocella | |
| 1,901,987 | A | 3/1933 | Roderick | |
| 2,181,106 | A | 11/1939 | Timmons et al. | 2/187 |
| 2,424,414 | A | 7/1947 | Oppenheimer | 2/187 |
| 4,023,212 | A | 5/1977 | Huffman | 2/197 |
| 4,439,871 | A | 4/1984 | Plastino | 2/422 |
| 4,864,662 | A | 9/1989 | Frank | 2/183 |
| 5,426,789 | A | 6/1995 | MacLeod | 2/175.1 |
| 5,488,740 | A | 2/1996 | Garza | 2/175.1 |
| 5,548,846 | A | 8/1996 | Bianchetti | 2/209.12 |
| 5,592,696 | A | 1/1997 | Oliver | 2/175.3 |
| 5,632,046 | A | 5/1997 | Green et al. | 2/183 |
| 5,724,676 | A | 3/1998 | Amendolia et al. | 2/195.2 |
| D406,441 | S | 3/1999 | Hornor et al. | D2/886 |
| 5,890,230 | A | 4/1999 | Guo | 2/175.1 |
| 6,061,835 | A | 5/2000 | Lien | 2/175.5 |
| 6,070,270 | A | 6/2000 | De La Torre | 2/171.1 |
| 6,154,889 | A | 12/2000 | Moore, III et al. | 2/418 |
| 6,163,888 | A | 12/2000 | Park | 2/183 |

*Primary Examiner*—John J. Calvert
*Assistant Examiner*—James Smith
(74) *Attorney, Agent, or Firm*—David A. Burge

(57) ABSTRACT

A hat is temporarily or permanently formed from fabric that matches or complements the appearance of one's ensemble by wrapping and tucking peripheral portions of the fabric about a relatively stiff yet pliable annular brim core member after a central portion of the fabric has been shaped to define a crown of the hat. The inner periphery of the annular brim core member may be provided with formations that enhance brim flexibility and fit, and/or that assist in holding the fabric covered hat in place on the wearer's head. Unless the fabric is permanently affixed to the brim core member, the brim core member may be reused with other pieces of fabric that match or complement other ensembles. The brim core member can be configured, shaped and styled to give a variety of attractive appearances to hats that are formed in this manner.

44 Claims, 13 Drawing Sheets

HATS, HAT COMPONENTS, AND METHOD OF FORMING HATS

BACKGROUND OF THE INVENTION

1. Field of the Invention

The present invention relates to hats that can be temporarily or permanently formed using a wide variety of fabrics that match or complement one's ensemble by wrapping and tucking peripheral portions of one or more selected pieces of fabric about a relatively stiff yet pliable annular brim core member after central portions of the selected piece or pieces of fabric have been shaped to define a crown of the hat. In its simplest form, the present invention provides a way in which hats can be quickly and easily formed for one-time wearing from fabric that matches or complements one's outfit by positioning a central portion of a piece of fabric over the crown of one's head to define the crown of a hat, positioning a generally annular shaped brim core member over the fabric covered crown of the head at a location where the hat is to have a brim, and covering the brim core member with such peripheral portions of the fabric as depend beneath the location of the brim core member by wrapping a first part of these peripheral portions to extend outwardly from the fabric covered crown of the head across the bottom surface of the brim core member, a second part to extend upwardly around the outer periphery of the brim core member, a third part to extend inwardly across the top surface of the brim core member, and a fourth part to be retainingly engaged by the inner periphery of the brim core member. In more complex forms of the invention, one or more crown shaping members can be put in place before the central portion of a piece of fabric is shaped to define the crown portion of a hat, the brim core member can be preconfigured or shaped and styled during hat formation to provide hats of a variety of appearances, and the brim core member can be provided with formations 1) that enhance brim flexibility or fit, 2) that assist in holding the fabric in securely retained engagement with the inner periphery of the brim core member, and/or 3) that assist in holding the fabric covered hat in place on the wearer's head. Unless the selected fabric used to form a hat is permanently affixed to the brim core member, the brim core member may be reused with other pieces of fabric to provide other hats that match or suitably complement other ensembles.

2. Prior Art

While it is known to specially make ladies' and mens' hats from flexible cover fabric that is selected to match or to complement the appearance of one's ensemble, specially made hats tend to be costly when ordered from a professional supplier. Inasmuch as the work involved in specially making a hat can prove tedious and may require skills that tax the abilities of the average person, the making of hats on a "do it yourself" or "at home" basis has often proven to be impractical.

While a variety of simplifications in the design of hats have been proposed in an effort to provide methods and means that enable those skilled in crafts to make their own hats using fabrics that match or complement one's ensembles, prior proposals have met with relatively little success in the marketplace due to their complexity, their cost and their failure to offer a flexible variety of attractive hat styles. A long-standing need for a simple approach that will enable a variety of hat styles to be formed on a "do it yourself" or "at home" basis by those who do not necessarily have good crafting skills, using inexpensive materials that can be reused, has gone unsatisfied by prior proposals.

SUMMARY OF THE INVENTION

The present invention addresses the foregoing and other drawbacks of the prior art by providing hats that are simply formed utilizing a minimum number of relatively low-cost components, and that offer flexibility of design as well as flexibility in the character of the fabrics that can be utilized.

A feature of the approach taken by the present invention to provide hats that can be simply, easily and relatively inexpensively formed on a "do it yourself" or "at home" basis is that, unless the components of a particular hat are permanently connected (as may be desired if a particular hat is to be repeatedly worn, or if the hat will need to be removed and put back in place on one's head repeatedly during a single wearing), the components can be reused to make other hats, and the fabric may be reused even for other purposes inasmuch as it is in no way damaged when hats are temporarily formed for single wearing use.

In one simple form of the invention, a hat is formed from a relatively stiff yet pliable, generally annular brim core member formed at least in large part from relatively thin material and having an inner periphery, an outer periphery, and oppositely facing upper and lower surfaces that extend between the inner and outer peripheries, wherein the inner periphery is adapted to extend perimetrically about a lower part of a crown of a head of a person who is to wear the hat; and a piece of flexible cover fabric having a central portion adapted to cover at least a large part of the crown of the head of said person, and having a peripheral portion that extends about the central portion and is adapted to cover the brim core member when the brim core member is positioned to extend perimetrically about the lower part of the crown of the head of said person at a time when the central portion is covering at least said large part of the crown of the head of said person, wherein the peripheral portion has a first part that connects with and extends outwardly from the central portion to cover the lower surface, a second part that connects with the first part and extends upwardly to cover the outer periphery, a third part that connects with the second part and extends inwardly from the outer periphery to cover the upper surface, and a fourth part that connects with the third part and is retainingly engaged by the inner periphery. Any remainder of the peripheral portion may be tucked between the lower surface and the first part, and/or may be utilized in the vicinity of the inner periphery to further enhance the appearance of the resulting hat.

In another simple form, the invention includes a method of forming a hat, comprising the steps of: providing an annular hat brim core member configured to extend perimetrically about a base of a crown portion of a head of a person who is to wear the hat, wherein the annular hat brim core member has top and bottom surfaces on opposite sides thereof that are interconnected by an inner periphery and an outer periphery; providing flexible fabric material having a central portion of sufficient size to cover an upwardly extending the crown portion of the head of the person who is to wear the hat, and having a peripheral portion of sufficient size to extend perimetrically about the central portion to cover exterior surface portions of the hat brim core member when the hat brim core member is positioned to extend perimetrically about a lower part of the central portion; forming the central portion of the flexible fabric material to define a configuration that conforms to the shape of and can serve as a cover for the upwardly extending crown portion of the head of the person who is to wear the hat, with the peripheral portion depending from the lower part thereof; positioning the brim core member to extend perimetrically about the lower part of the central portion; and, wrapping the peripheral portion of the flexible fabric material to extend from the inner periphery across the bottom of the brim core member to the outer periphery, upwardly across the outer periphery, inwardly from the outer periphery to the inner periphery, and into retaining engagement with the inner periphery, for example by extending downwardly between the inner periphery and the crown of the hat. Any remainder (i.e., "excess" or non-essential part of the peripheral portion) may be tucked into a space between the bottom of the brim core member and such fabric as covers the bottom of the brim core member, or may be used in the vicinity of the inner periphery to further enhance the appearance of the resulting hat.

Flexibility can be added to the inner peripheral region of the brim core member by utilizing a rubber band or other resilient member to define the inner periphery, or by providing arcuate portions of the brim core member that are only intermittently connected to other parts of the brim core member about the inner peripheral region. Slits can be provided at selected locations in the brim core member to enhance its flexibility and its ability to be shaped, as desired, in an effort to stylize the resulting hat. More than one piece of fabric may be used to define the crown of the hat and/or to cover the brim of the hat, to give contrasting colors or to provide a way in which one-sided fabrics (such as chair covering and wall hanging fabrics) can be used to attractively cover both the crown and the brim of a hat. And, inwardly extending projections can be provided along the inner periphery to enhance the fit of the hat on a wearer's head and/or to help in retaining the hat on a wearer's head.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF THE PREFERRED EMBODIMENT

Figure 1:
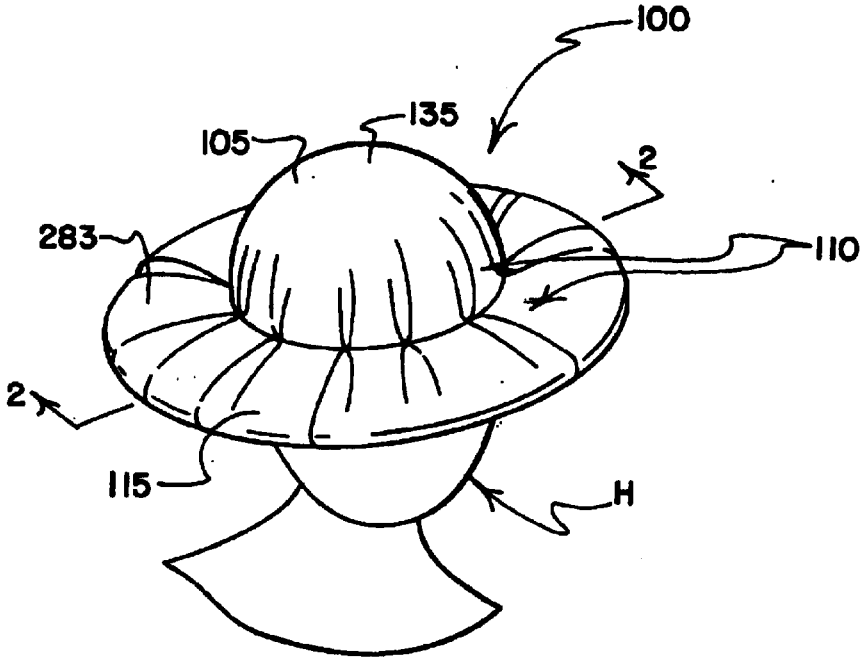
FIG. 1 is a perspective view of a first form of a hat that embodies features of the present invention, shown covering the crown of a person's head.
Figure 3:
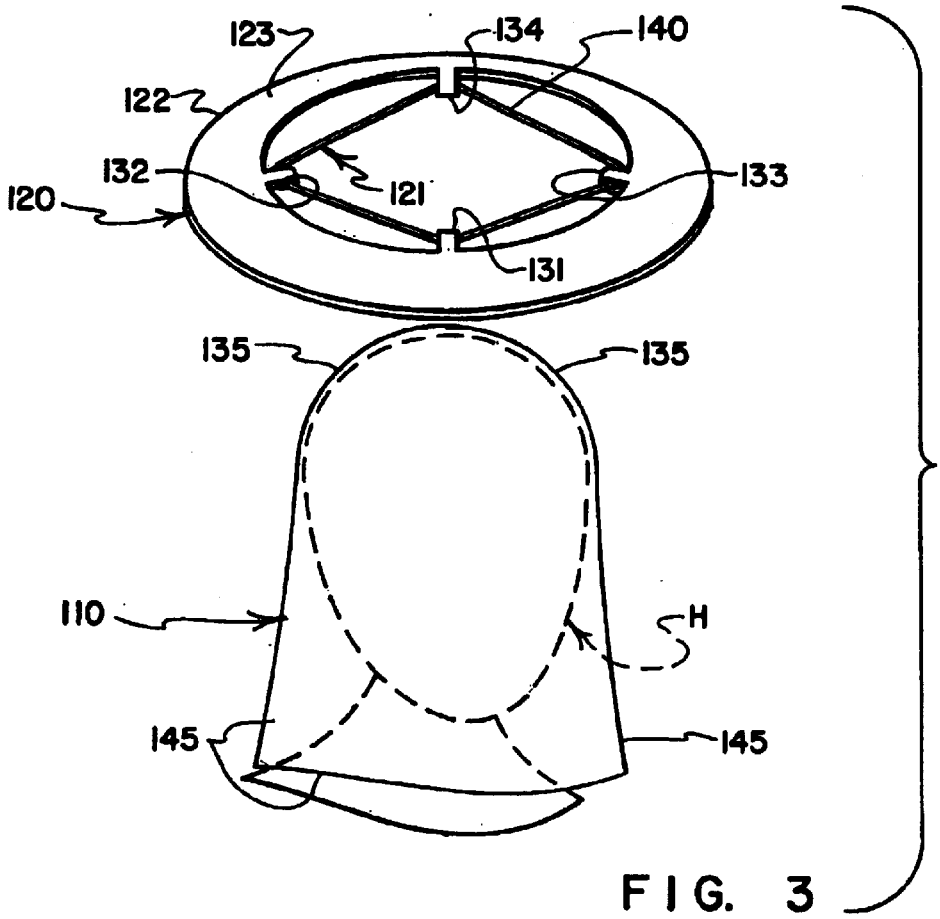
FIG. 3 is a perspective view showing components of the hat of FIG. 1 including a piece of fabric draped over the crown of a person's head and a first form of a brim core member that embodies features of the present invention.

Referring to FIG. 1, one form of a hat that embodies features of the present invention is indicated generally by the numeral 100. Referring to FIG. 3, components of the hat 100 include a piece of fabric 110 and a generally annular brim core member 120. As will be explained, the hat 100 is made by shaping a central portion 135 of the fabric 110 to form a crown 105 of the hat 100, and by folding and tucking peripheral portions 145 (see FIGS. 3–5) of the fabric 110 about the brim core member 120 to form a brim 115 of the hat 100.

Figure 10:
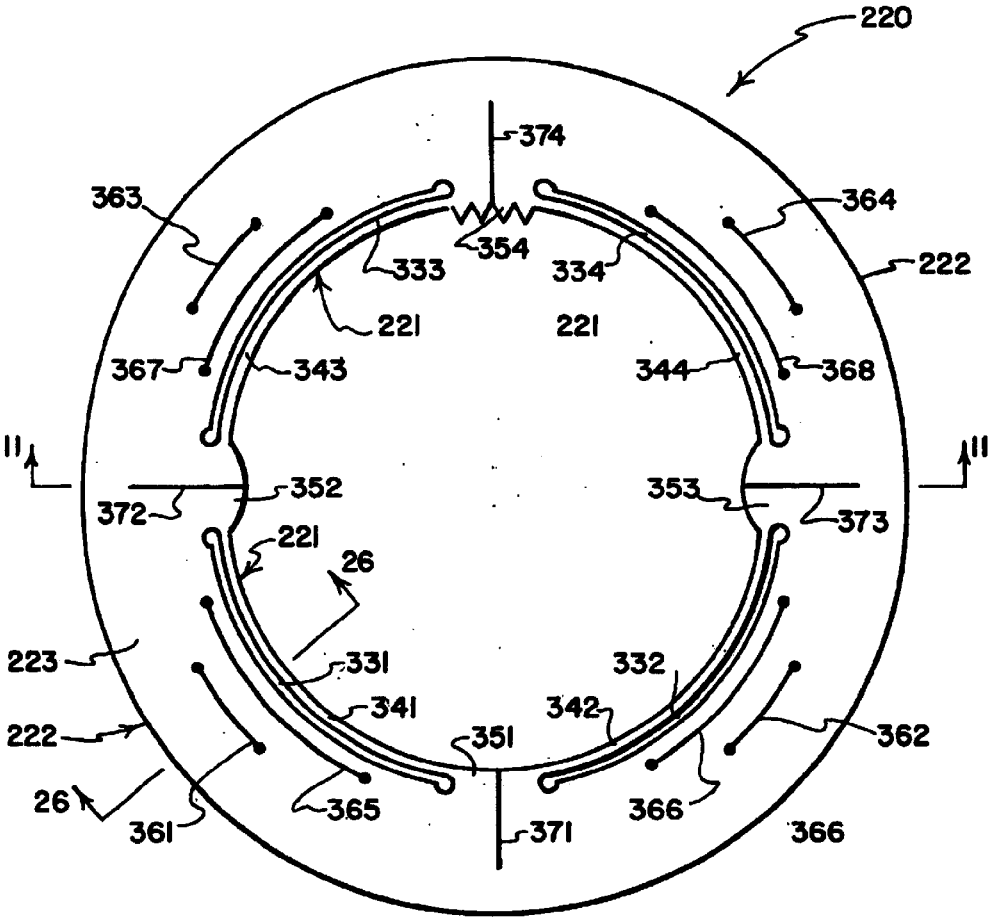
FIG. 10 is a top plan view of a second form of brim core member that is formed as a single-piece cut from a sheet of flat stock.
Figure 11:
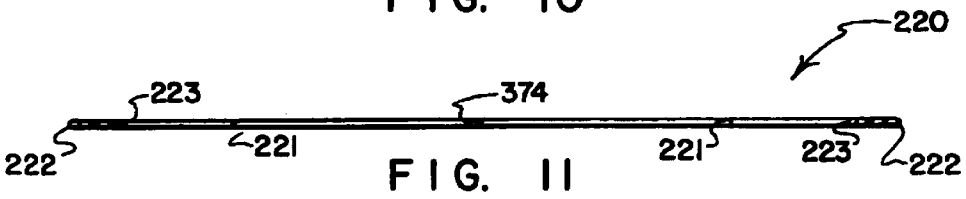
FIG. 11 is a sectional view as seen generally from a plane indicated by a line 11—11 in FIG. 10.
Figure 12:
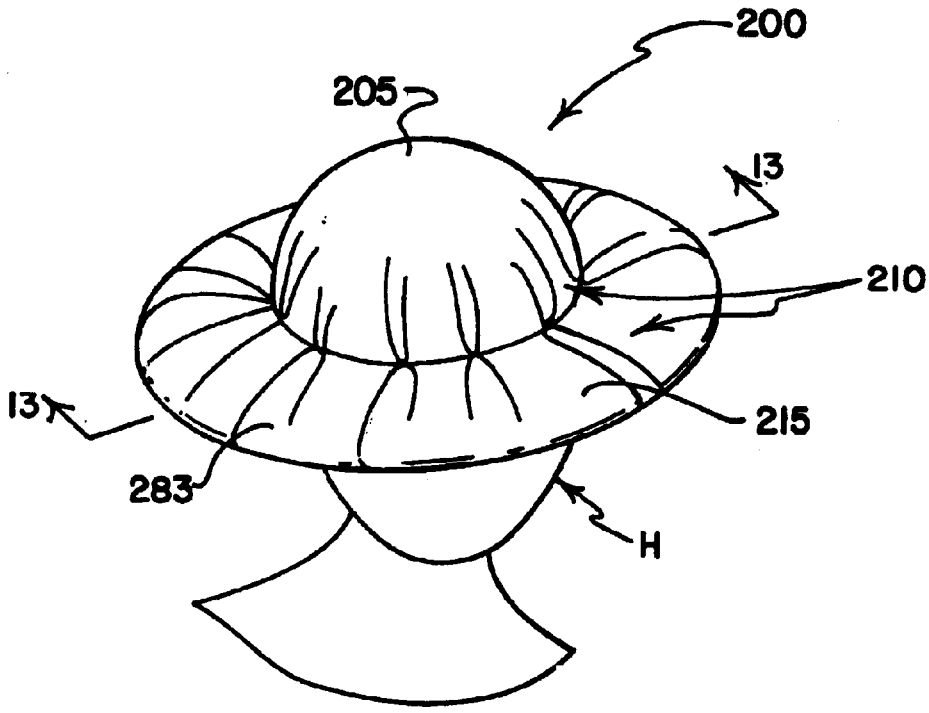
FIG. 12 is a perspective view of a second form of hat that is made using the second form of brim core member depicted in FIG. 10.
Figure 13:
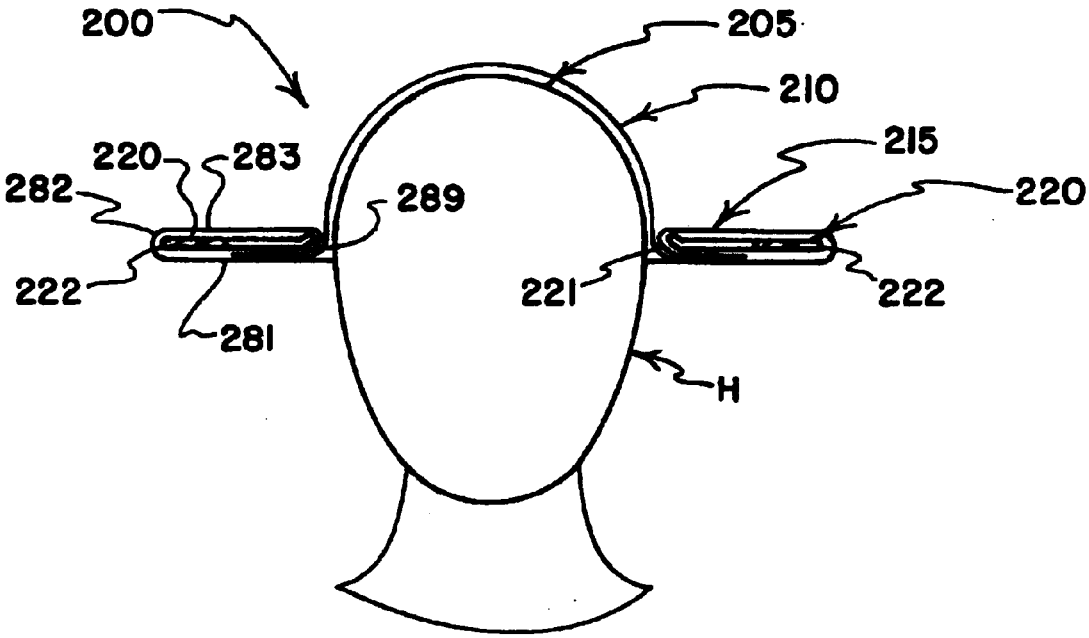
FIG. 13 is a sectional view as seen generally from a plane indicated by a line 13—13 in FIG. 12.

Referring to FIG. 12, a second form of a hat that embodies features of the present invention is indicated generally by the numeral 200. The second hat 200 shown in FIG. 12 has substantially the same appearance as the first hat 100 shown in FIG. 1, and is made in substantially the same way, namely by shaping a central region of a piece of fabric 210 to form a crown 205 of the hat 200, and by folding and tucking peripheral portions of the fabric 210 about a brim core member 220 that differs from the first form of brim core member 120 which is used in forming the hat 100. The second form of brim core member 220 is depicted in FIG. 10, and will be described later herein.

Figure 14:
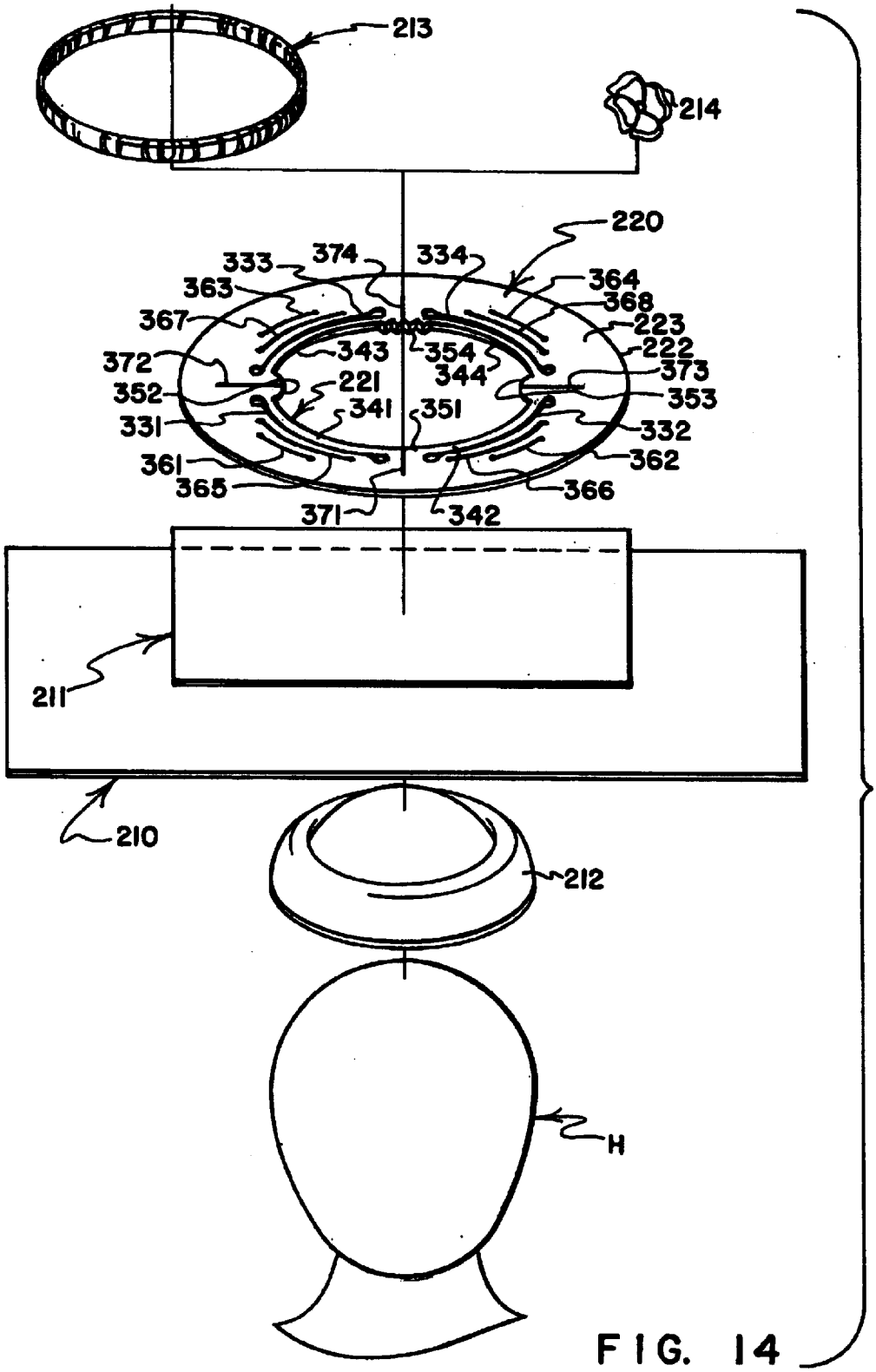
FIG. 14 is a perspective view showing the components of the second form of hat together with a sample set of optional components that can be used to make a third form of hat having an appearance that differs from the second form of hat.
Figure 15:
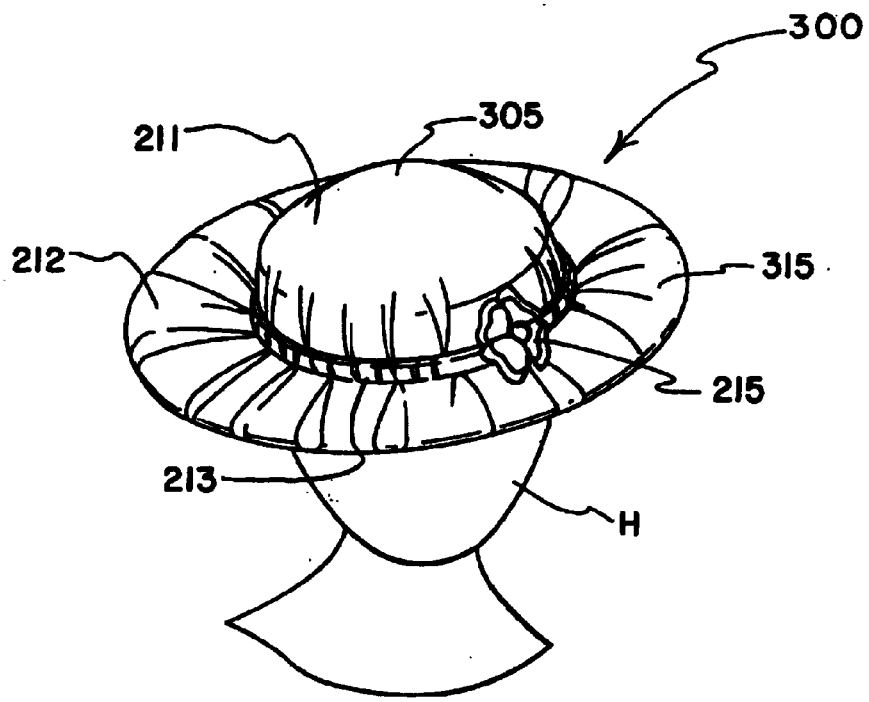
FIG. 15 is a perspective view of a third form of hat made using the components depicted in FIG. 14.

Referring to FIG. 15, a third form of hat that embodies feature of the present invention is indicated generally by the numeral 300. The third hat 300 shown in FIG. 15 is formed from components that are depicted in FIG. 14—which include the same brim core member 220 that is used in forming the second hat and a first piece of fabric 210, together with a second piece of fabric 211, a crown form insert 212, a resilient decorative band 213, and an artificial flower 214. The purpose of including the illustrations that relate to the third form of hat 300 is to give examples of how optional components can be added to the simple dual set of components (namely the fabric 210 and the brim core member 220) that are used to form the second form of hat 200. A cross-sectional view showing these components assembled is provided in FIG. 16.

Figure 20:
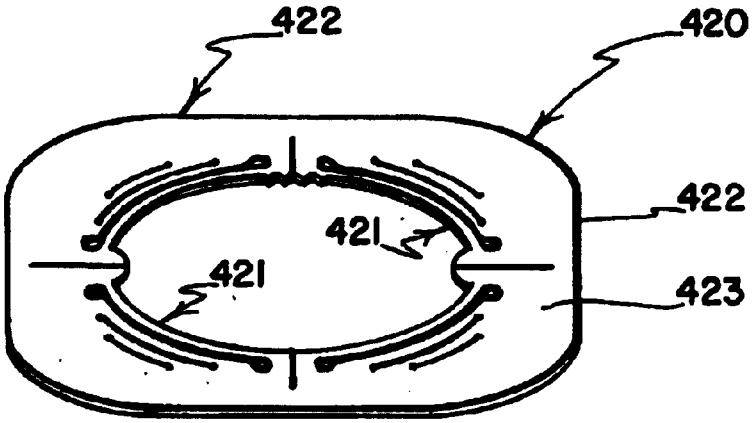
FIGS. 20, 21 and 22 are top plan views showing still other alternate brim core member configurations that can be employed to provide hats having still other appearances.
Figure 21:
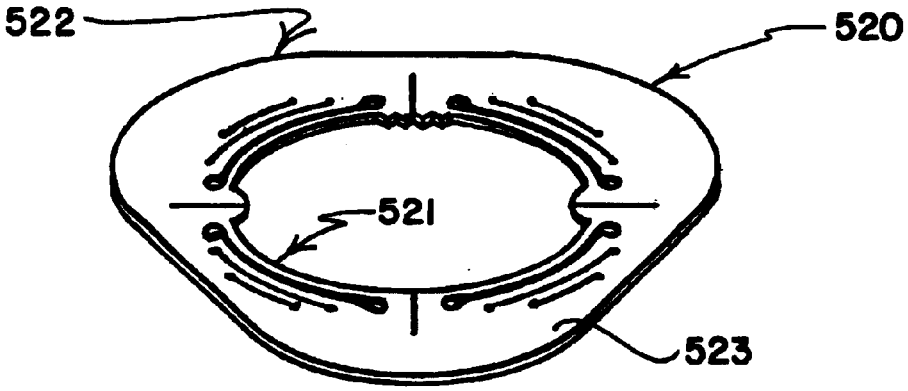
Figure 22:
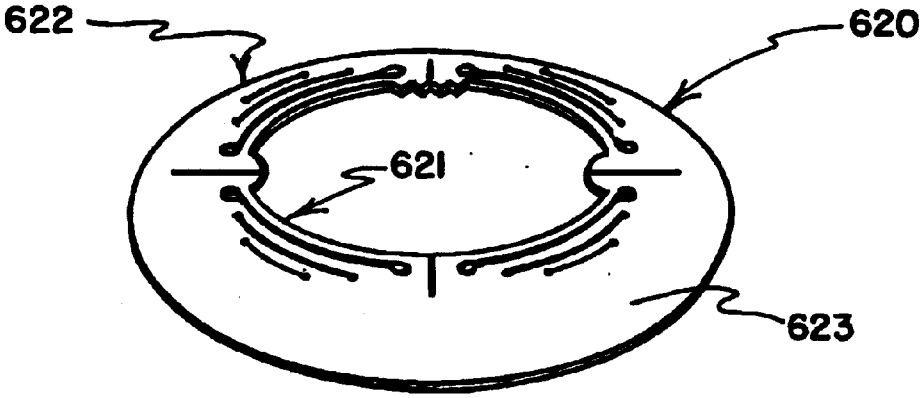
Figure 23:
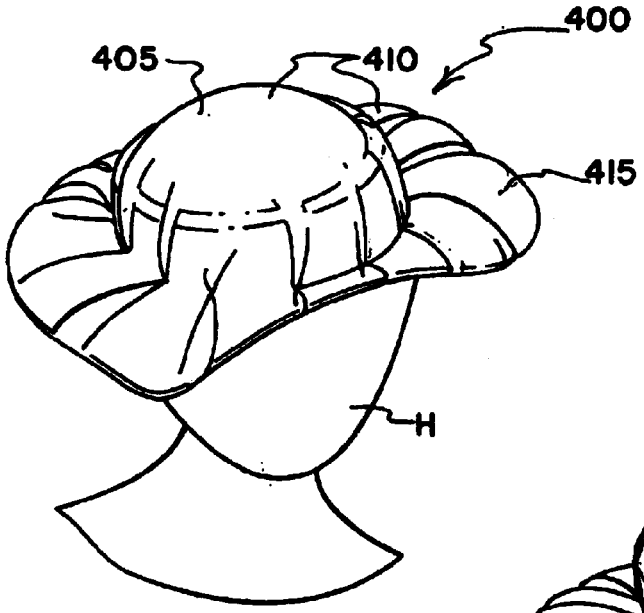
FIG. 23 is a perspective view of a hat that is formed using the brim core member of FIG. 20.
Figure 24:
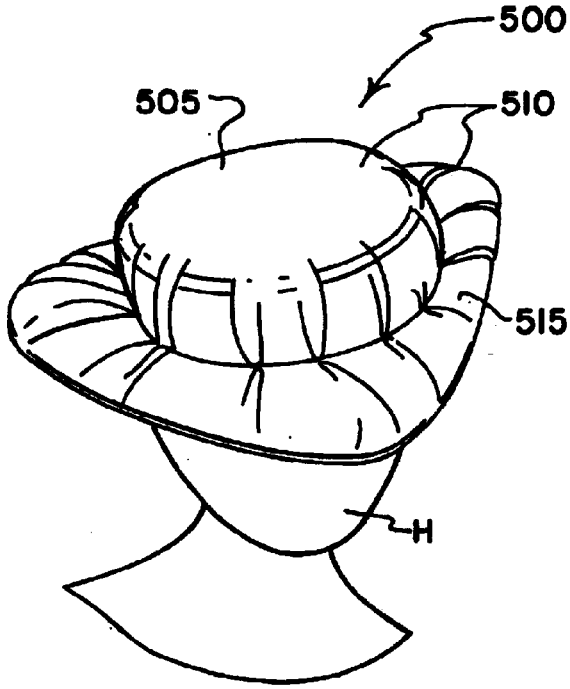
FIG. 24 is a perspective view of a hat that is formed using the brim core member of FIG. 21.
Figure 25:
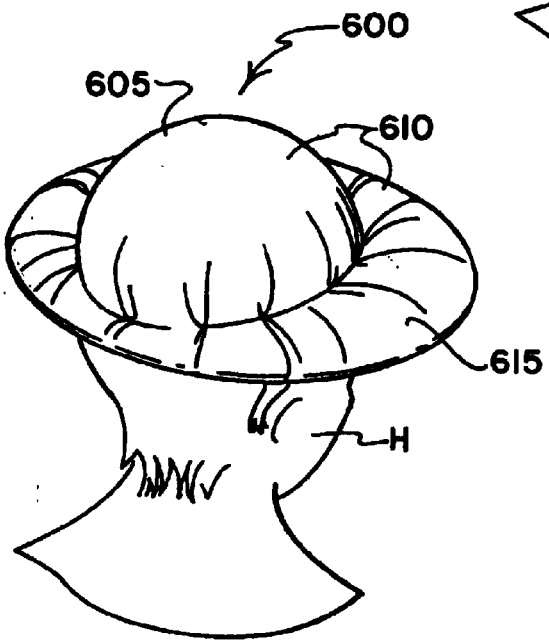
FIG. 25 is a perspective view of a hat that is formed using the brim core member of FIG. 22.

Referring to FIGS. 23, 24 and 25, three more forms of hats that embody features of the present invention are indicated generally by the numerals 400, 500 and 600, respectively. The hats 400, 500, 600 are made in the same way that the second or third hats 200, 300 are made, namely by utilizing pieces of fabric 410, 510, 610 (in the manner that the fabric pieces 110, 210, 211 that are used to cover the hats 100, 200, 300 are folded and tucked about brim core members, as will be explained shortly) that are formed, wrapped and tucked about brim core members 420, 520, 620 that are illustrated in FIGS. 20, 21 and 22, respectively. The differences between the brim core members 420, 520, 620 and the second brim core member 220 have only to do with the configuration of the outer peripheries of the brim core members 420, 520, 620 which are more complexly configured than the relatively uniform width provided by the inner and outer peripheries of the second brim core member 220, which are relatively equally spaced all around the periphery of the brim core member 220.

Because all of the brim core members 120, 220, 420, 520, 620 are referred to herein as being "substantially annular" in appearance, an explanation should be made as to what is meant by the terms "annular" and "substantially annular" as used in this document to refer to the configuration of brim core members. These terms are intended to be interpreted as broadly including a wide variety of generally ring-like shapes that each provide an "inner periphery" (i.e., an interior region, perimeter, portion or surface area such as is indicated by the numerals 121, 221, 421, 521 and 621 in FIGS. 8, 10, 20, 21 and 22, respectively) that is configured to fit about the head of a hat wearer at a location where a brim of the hat is to be provided, and an "outer periphery" (i.e., an exterior region, perimeter, portion or surface area such as is indicated by the numerals 122, 222, 422, 522 and 622 in FIGS. 8, 10, 20, 21 and 22, respectively) that can take almost any desired shape so long as the resulting brim core member provides at least a short reach of material that extends between the outer periphery and the inner periphery (such as is indicated by the numerals 123, 223, 423, 523 and 623 in FIGS. 8, 10, 20, 21 and 22, respectively).

The reaches of material that extend between the inner and outer peripheries of a particular brim core member can be of substantially uniform width as they extend about the perimeter of the particular brim core member (as is illustrated by the material reaches 122, 222 of FIGS. 8 and 10 that are employed in providing the hats 100, 200 with substantially uniform width brims 105, 205 as depicted in FIGS. 1 and 12, respectively); or, these reaches of material can be quite non-uniform in width (as is illustrated by the material reaches 400, 500, 622 that are employed in providing the hats 400, 500, 600 with brims 405, 505, 605 of non-uniform width, as depicted in FIGS. 23, 24 and 25, respectively.

Any of the brim core members 110, 210, 410, 510, 610 can be given a three-dimensional shape, if this is desired; and, a variety of techniques can be employed to do this. For example, a brim core member can be twisted or otherwise "styled" during formation of a hat; or, a brim core member can be pre-configured so as to feature a three dimensional shape even before it is brought into contact with the fabric that is to be wrapped about it.

Figure 7:
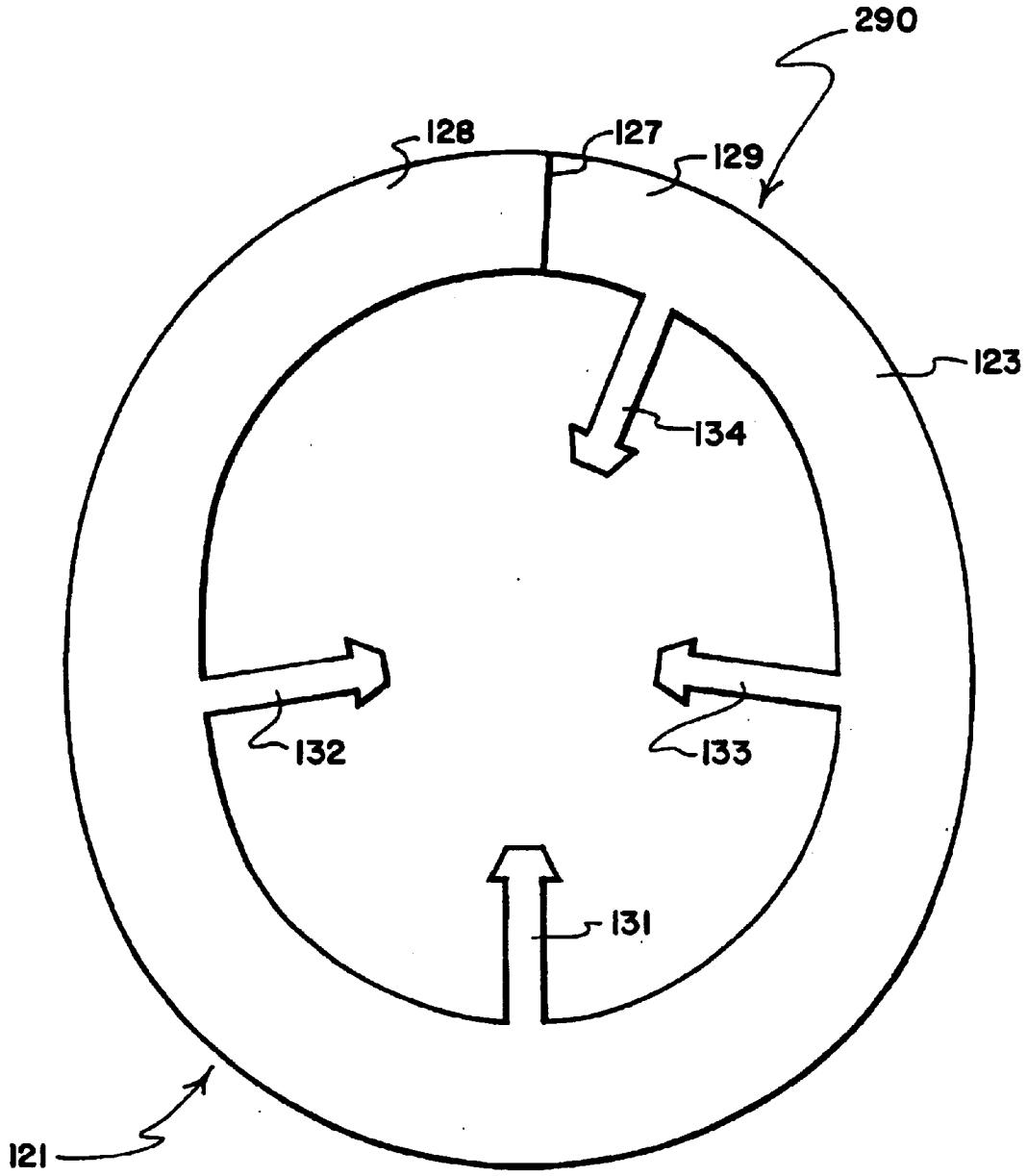
FIG. 7 is a top plan view of showing how one brim core component used in forming the hat of FIG. 1 can be cut from a sheet of relatively stiff but pliable flat stock.

Referring, for example, to FIG. 7, a component 290 that is to be used in forming the brim core member 220 can be cut from a flat sheet of relatively stiff but pliable plastic or paperboard material, or the like, so that it features a relatively uniform width reach 123 of material between its inner and outer periphery, and a substantially radially extending cut 127 located between two end regions 128, 129. The component 290 also includes four radially inwardly extending tab formations 131, 132, 133, 134.

Figure 8:
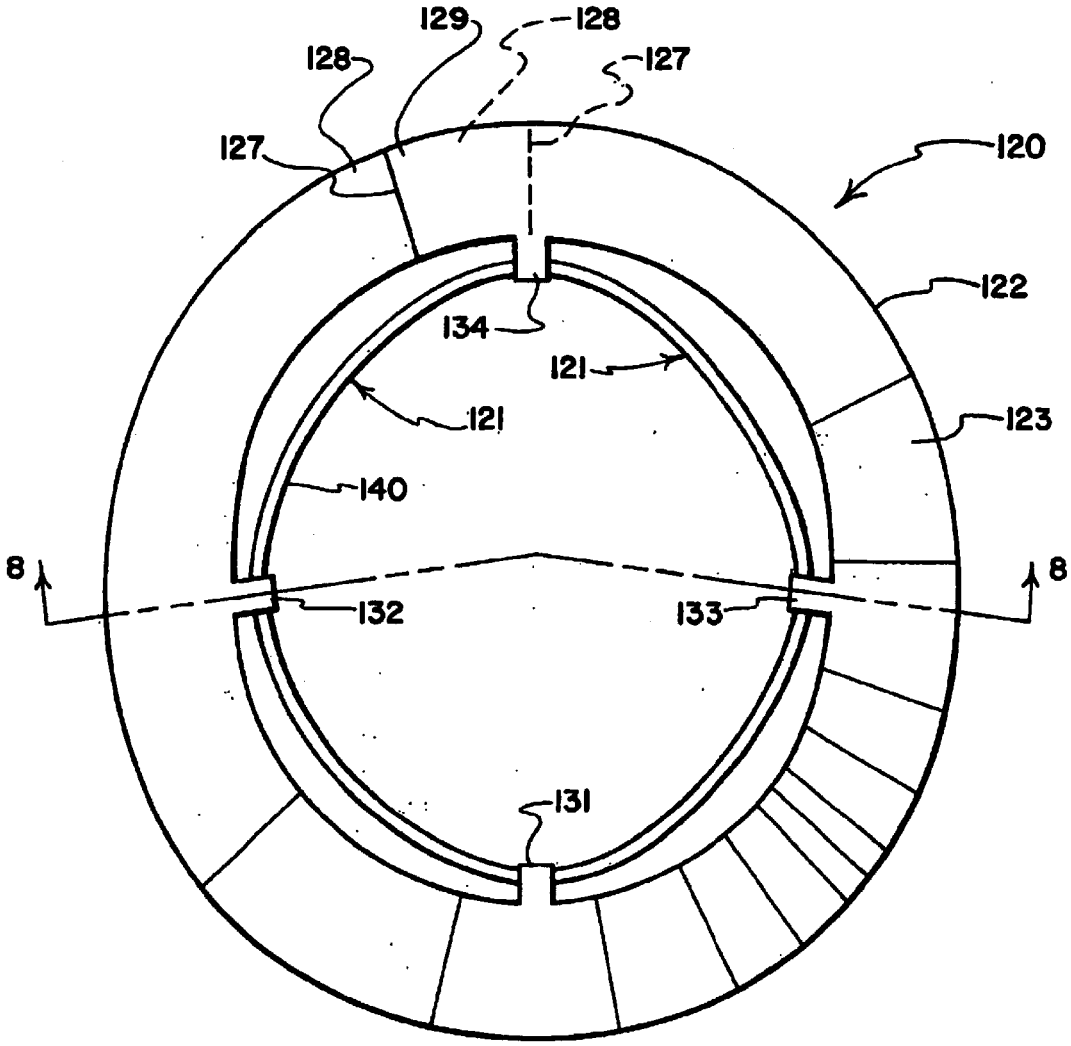
FIG. 8 is a top plan view of the assembled components of the first form of brim core member which is used in the first form of hat that is depicted in FIG. 1, with end portions of the brim core component depicted in FIG. 7 being overlapped and connected to give the resulting brim core member a three-dimensional shape.
Figure 9:
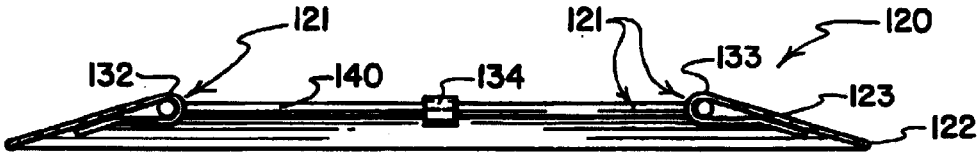
FIG. 9 is a sectional view as seen from planes indicated by a broken line 9—9 in FIG. 8.

Referring to FIG. 8, a three-dimensional shape is given to the component 290 by drawing into overlapping relationship the end regions 128, 129 and affixing these overlapping regions one to another as by bonding or by the use of conventional fasteners such as staples (not shown). To complete the brim core member 120, outer ends of the tab formations 131, 132, 133, 134 are wrapped about a resilient rubber band 140 (or length of resilient rubber tubing or the like) and are secured when so wrapped to provide the brim core member 120 with a resilient interior periphery 121 that is defined principally by the resilient band 140. What the resilient band 140 provides is a means of rendering flexible and resilient the interior region of the brim core member 120 so that portions of the fabric 110 can be easily folded and tucked into place to define the brim 115 of the hat 100 depicted in FIG. 1, as will be explained in greater detail shortly.

Referring to FIG. 10, the second brim core member 220 (and, for that matter, the brim core members 420, 520 and 620 depicted in FIGS. 20, 21 and 22 which have everything in common with the second brim core member except the configurations of their outer peripheries) is formed (preferably by stamping) from a flat sheet of relatively stiff but yet pliable plastic or paperboard material or the like. Interior region flexibility and resilience (to aid the tucking of fabric thereabout, and to help the resulting hat have a fit that will accommodate heads of a variety of sizes and shapes) is provided in this second form of brim core member 220 by providing arcuate incisions 331, 332, 333, 334 that leave arcuate strips of material 341, 342, 343, 344 that are spaced apart by connecting formations 351, 352, 353, 354 defining the inner periphery 221 of the brim core member 220.

At the front of the brim core member 220, the formation 351 preferably does not extend radially inwardly; however, at the sides of the brim core member 220, the formations 352, 353 preferably are rounded to project slightly inwardly to assist in gripping opposite sides of the head of the wearer; and, at the rear, the formation 354 preferably has a toothed inwardly projecting form that also serves to grip the hair of the head of the wearer of the resulting hat. Configuring one or more of the formations 351, 352, 353, 354 to project inwardly to aid in holding the resulting hat on the head of a wearer is optional and non-essential to the practice of the invention.

Likewise, optional circumferentially extending slits 361, 362, 363, 364 may be formed through the reach 223 of material that extends between the inner periphery 221 and the outer periphery 222 of the brim core member 220; and, radially extending slits 371, 372, 373, 374 also may be provided. Slits of this general type can be added, as desired, on an optional basis, to enhance the shape-ability of the brim core member 220 by enhancing its flexibility. Also, optional circumferentially extending slits 365, 366, 367, 368 can be added that are located in the region of the inner periphery 221 to provide formations that can aid in receiving and retainingly engaging peripheral portions of the fabric that covers the brim of a hat to hold the fabric in place at the inner periphery 221, as will be more fully explained in conjunction with FIGS. 26 and 27.

Hats that embody features of the present invention can be formed quickly and easily for one-time wearing (by not permanently fastening the assembled components of the hat in their final assembled positions), or can have their components permanently fastened together to provide a hat that is capable of repeated use. If permanent fastening for repeated use is desired, the needed fastenings can be accomplished using needle and thread to attach fabric to an associated brim core member at any of a variety of points (selected by the person who is making the needed connections); or, instead of using needle and thread to form permanent connections, staples or other types of commercially available fasteners used commonly to hold articles in fixed relationship one to another may be used.

Figure 4:
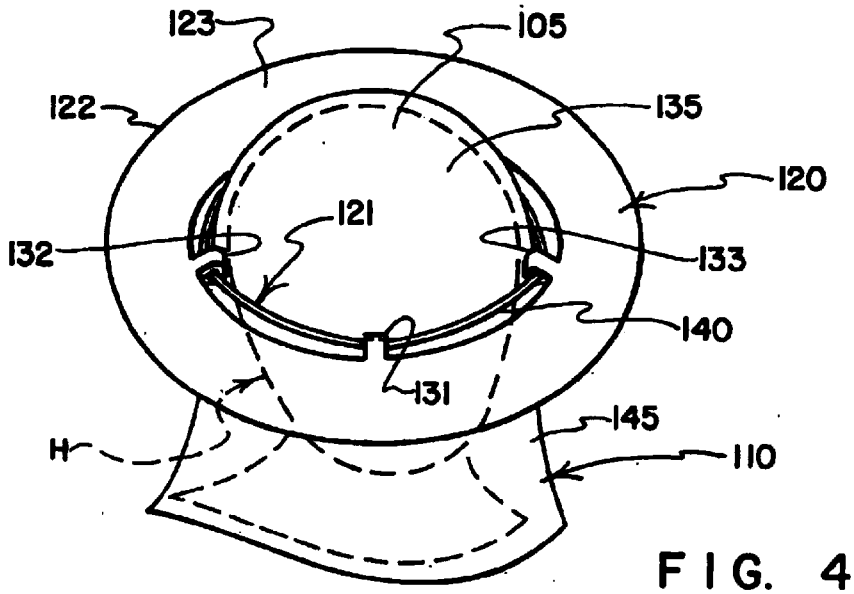
FIG. 4 is a perspective view showing the components of FIG. 3, with the brim core member surrounding the fabric covered crown of the person's head at a location where a hat brim is to be provided, depicting a step in the formation of the hat of FIG. 1 in accordance with a method of the present invention.
Figure 5:
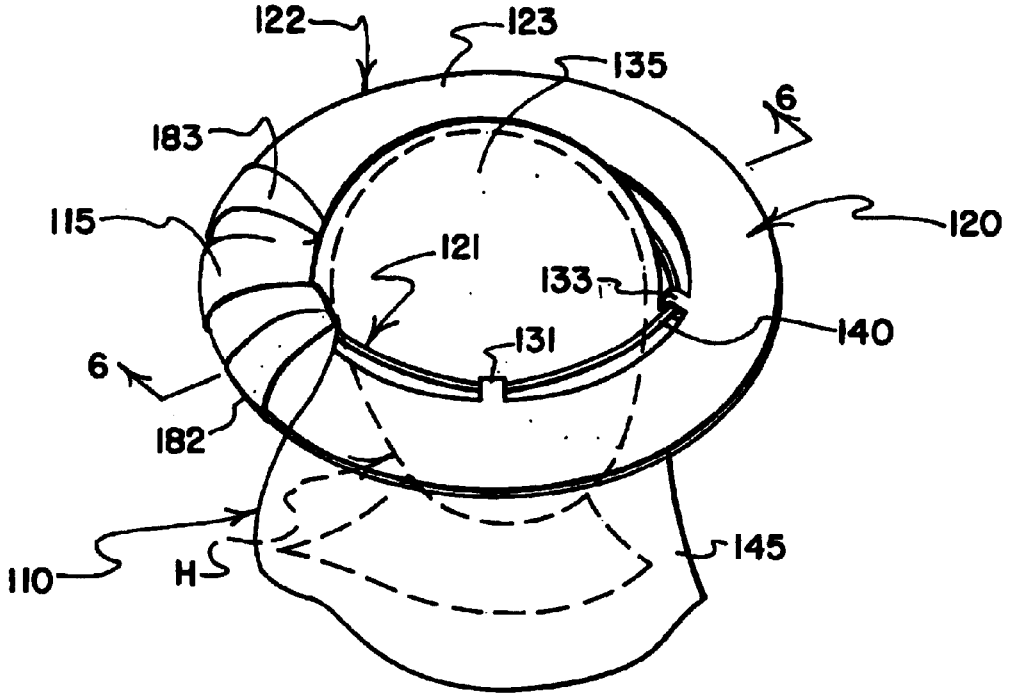
FIG. 5 is a perspective view showing how the fabric of FIG. 4 is folded and tucked about the brim core member during formation of the hat of FIG. 1.

A simple method of the present invention that preferably is used to form the hat of FIG. 1 has its steps illustrated in FIGS. 3, 4 and 5. While the hat 100 can be formed in-situ on the head of a manikin or other artificial head-form simulation (not shown), the hat 100 preferably is formed in-situ atop the head "H" of a person. Forming the hat 100 atop the head "H" of a person is consistent with forming the hat 100 for "one time use" inasmuch as the head "H" is utilized not only in the forming of the hat 100 but also in holding the fabric 110 in place to define a crown 105 of the hat 100, and in holding the fabric 110 and the brim core member 120 in place to define a brim 115 of the hat 100.

Referring to FIG. 3, a first step in the formation of the hat 100 atop the head "H" begins with the selection of a suitable piece of fabric (or a plurality of pieces of fabric such as are depicted in FIG. 14) to form the crown 105 of the hat 100, and to cover the brim 115 of the hat 100. The selected fabric 110 is draped over the head "H" so that a central portion 135 of the fabric 110 defines the crown 105 that covers the crown of the head "H," with peripheral portions 145 of the fabric 110 (i.e., edge portions that depend beneath a location on the fabric-draped head "H" where the brim 115 is to be formed) extending downwardly from the central portion 135 so as to surround lower portions of the head "H" including the face and at least portions of the neck of the head "H," as depicted in FIG. 3.

Figure 2:
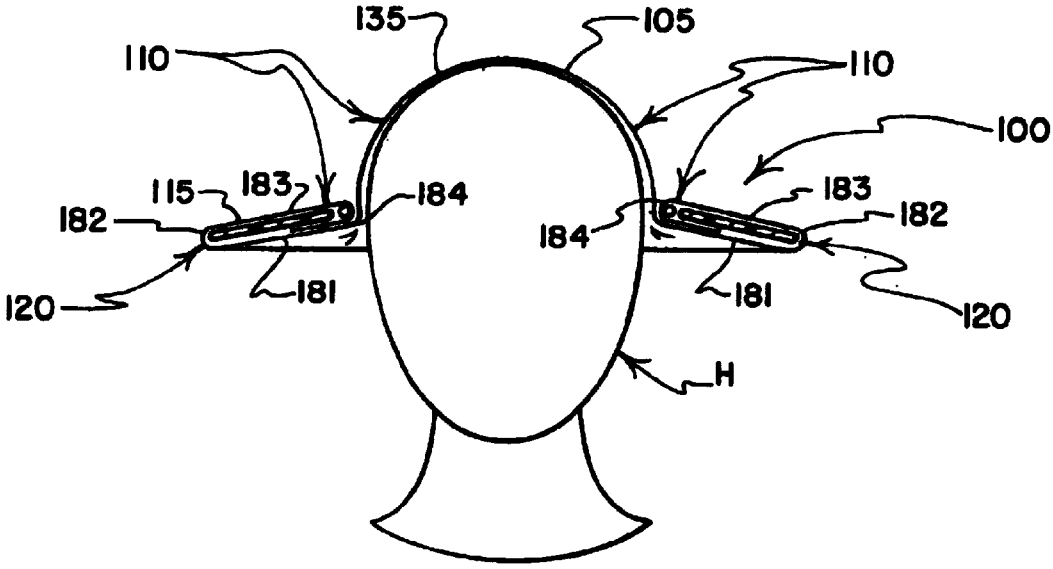
FIG. 2 is a sectional view of the hat of FIG. 1, as seen generally from a plane indicated by a line 2—2 in FIG. 1.
Figure 6:
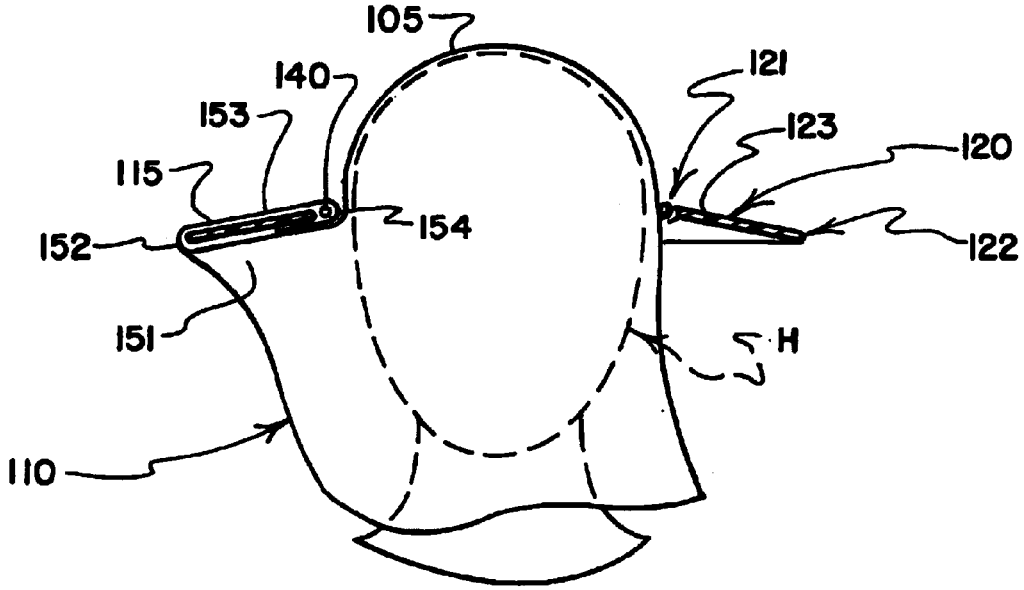
FIG. 6 is a sectional view as seen generally from a plane indicated by a line 6—6 in FIG. 5.
Figure 17:
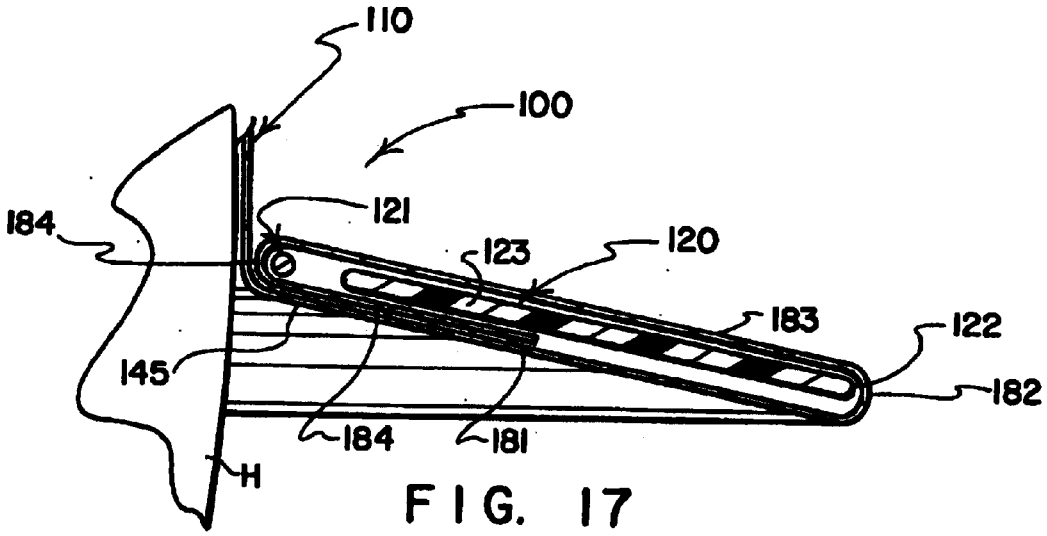
FIG. 17 is an enlargement of a portion of the sectional view of FIG. 2.

Referring to FIGS. 2, 6 and 17, the brim core member 120 is next put into position so as to surround the crown 105 at a location where the brim 115 of the hat 100 is to be formed. The depending peripheral fabric 145 is then stretched outwardly to define a first reach of fabric 181 that covers the bottom or underside of the brim core member 120. A second reach 182 of the peripheral fabric 145 that is connected to the first reach 181 then is extended upwardly to cover the outer periphery 122 of the brim core member 120, whereafter a third reach 183 of the fabric 145 that is connected to the second reach 182 is extended inwardly to from the outer periphery 122 to the inner periphery 121 to cover the top surface of the brim core member 120. Lastly, a fourth reach 184 of the peripheral fabric 145 is brought into receiving engagement with the inner periphery 121 (so as to be held in place) of the brim core member 120.

One way in which the fourth reach 184 can be receivingly engaged by the inner periphery 121 calls for the fourth reach 184 to be tucked between the inner periphery 121 and the central portion 135 of the fabric 110 at the base of the crown 105, and thence outwardly so as to extend into a space located between the lower bottom surface of the brim core member 120 and the first reach 181 of the fabric 145. Another way in which the fourth reach 184 can be retainingly engaged by the inner periphery 121 will be discussed later herein, in conjunction with FIGS. 26 and 27, wherein a slightly more complex tucking of the fourth reach is effected in the region of the inner periphery 121—an approach that is especially useful when the fabric being used to wrap the brim core member of a hat is quite slick, such as a silk or satin type of fabric.

Figure 16:
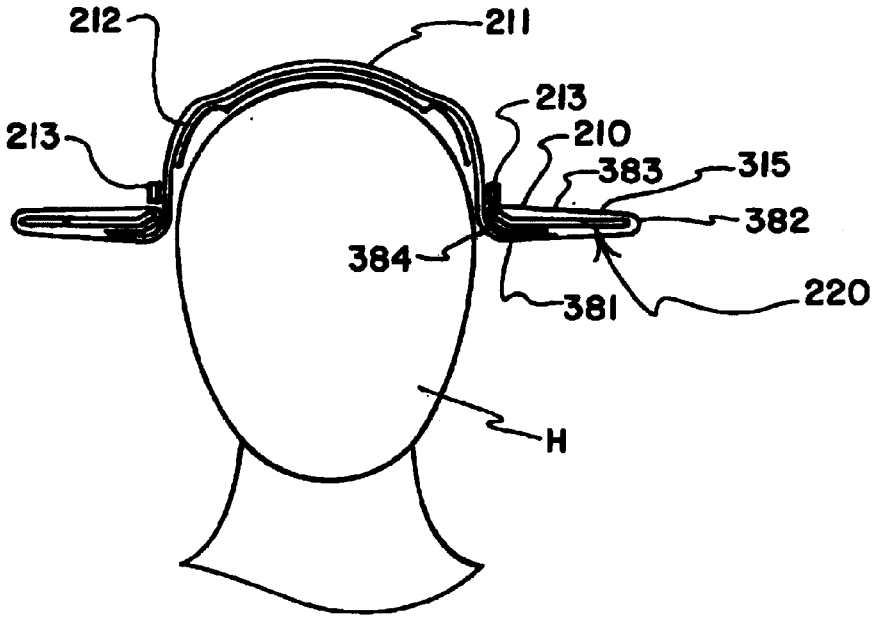
FIG. 16 is a sectional view as seen generally from a plane indicated by a line 16—16 in FIG. 15.
Figure 18:
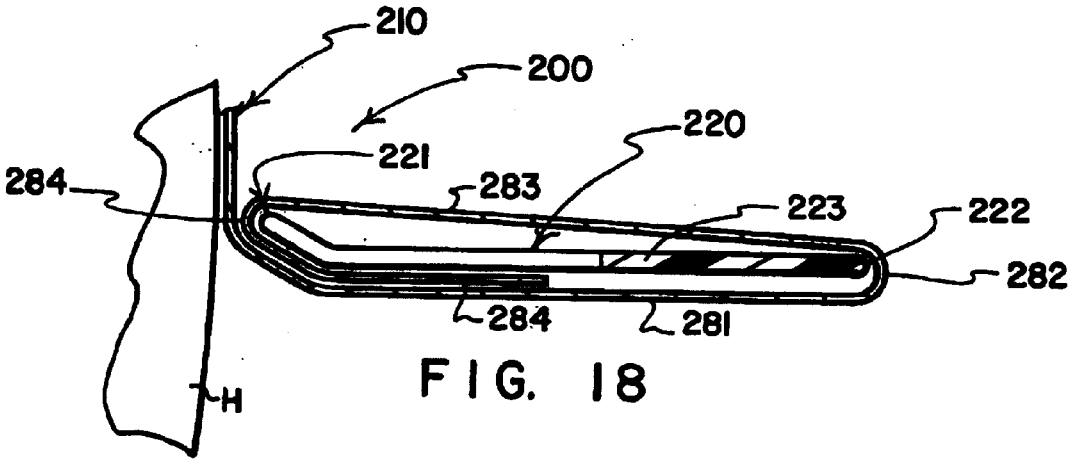
FIG. 18 is an enlargement of a portion of the sectional view of FIG. 13.

The second hat 200 is formed in substantially the same way as the first hat 100, using a central region 235 of the fabric 210 to form the crown 205, and then folding and tucking peripheral portions of the fabric 210 as is depicted in FIG. 18 to provide first, second and third reaches 281, 282 and 283 that wrap the brim core member 220 in the same way that the reaches 181, 182, 183, 184 wrap the brim core member 120, and a fourth reach 284 that preferably is receivingly engaged by the inner peripheral region 221 (as depicted in FIG. 17) just as the fourth reach 184 is receivingly engaged by the inner peripheral region 121 (as depicted in FIG. 16).

The third hat 300 is formed in much the same way as the first and second hats 100, 200—except that minor modifications are made to accommodate the presence of a second piece of fabric 211, the crown form member 212, the decorative band 213 and the artificial flower 214. The crown form member 212 is placed atop the head "H" before the first fabric 210 is laid atop the head "H" so that a central part of the first fabric 210 covers the crown of the head "H" and peripheral portions of the first fabric 210 drape down therefrom. The second fabric 211 then is laid over the crown of the head "H" and the brim core member 220 is put in place where a hat brim is to be formed.

Figure 19:
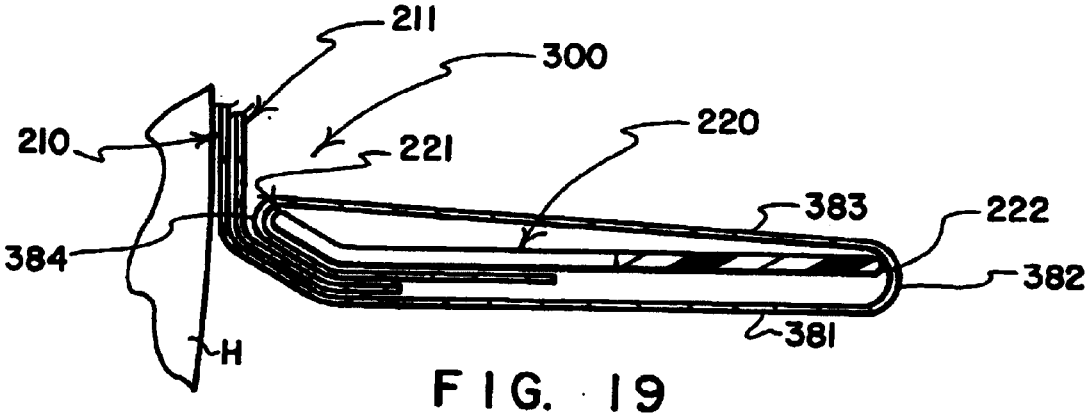
FIG. 19 is an enlargement of a portion of the sectional view of FIG. 16.

Referring to FIGS. 16 and 19, peripheral portions of the fabrics 210, 211 then are folded about the brim core member 220 in the manner described above. Because the second fabric 212 is provided (in this example) in a smaller form than the first fabric 211 so as to cover mainly only the crown of the head "H", it is mainly the peripheral portions of the first fabric 210 that forms first, second, third and fourth reaches 381, 382, 383, 384 that fold about the brim core member 220 in the manner that the reaches 281, 282, 283, 284 fold about the brim core member 220, as depicted in FIG. 18.

An advantage of utilizing two pieces of fabric 210, 211 is that, with some fabrics (such as upholstery fabrics, drapery fabrics and the like), there is a "good" or "display" side, and a "back" side that is not intended to be displayed at all. If two pieces of such fabric are used, they can be arranged back-to-back so that only their display sides face outwardly—so that, when the two pieces of fabric are installed in the manner described above, the upper or second fabric 211 will cover the crown with an outwardly facing display surface, and the lower or first fabric 210 will cover the brim with an outwardly facing display surface. This approach also can be used to cover the crown and the brim with fabrics of different appearance that match or complement other elements of one's ensemble.

Still another advantage that can be provided by utilizing two pieces of fabric to cover the crown of the head of the wearer is that a crown form member can be inserted between the two pieces of fabric so that the crown form member does not come into direct contact with the head of the wearer (because it is sandwiched between the two pieces of fabric).

Figure 26:
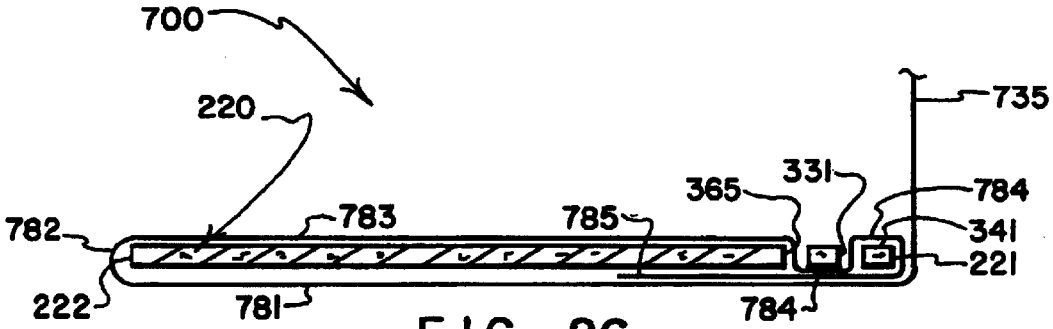
FIG. 26 is a sectional view as seen from a plane indicated by a line 26—26 in FIG. 10, but with reaches of fabric added that wrap the depicted portion of a brim core member to illustrate still another alternate embodiment of hat; and, FIG. 27 is a sectional view similar to FIG. 26 illustrating a modification of the alternate hat embodiment of FIG. 26 wherein remainder regions of a fabric that wraps the brim core member are utilized to enhance the appearance of the resulting modified hat embodiment.
Figure 27:
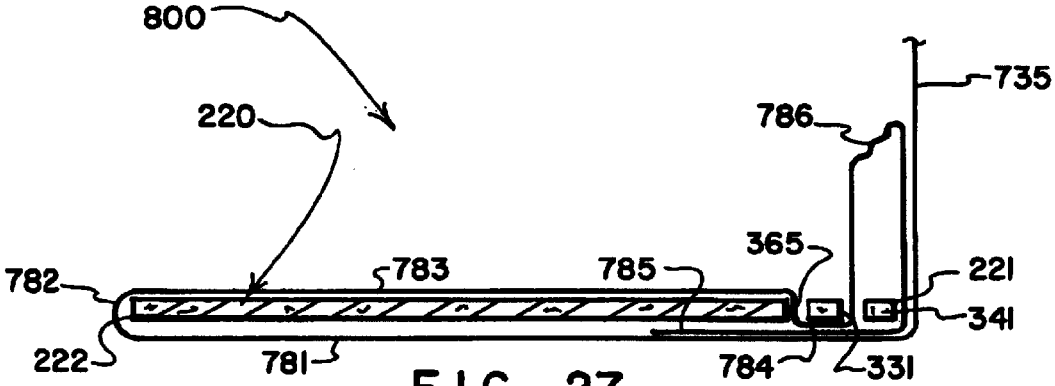

Because it may be desirable to utilize fabrics that such as silk or satin that are quite slick to wrap the brim core members of the aforedescribed hats, and because these very slick fabrics may tend to come undone if they are not more securely held in place adjacent the inner peripheries of the brim core members, FIGS. 26 and 27 depict modified hat embodiments 700, 800 that serve to more secure retaining engagement of fabrics at the inner peripheries of their brims. While the embodiments 700, 800 employ the brim core member 220 (depicted in FIG. 10), the manner in which the circumferentially extending slits 365, 366, 367 and 368 of the brim core member 220 are utilized to retainingly engage peripheral portions of a brim wrapping fabric can be applied to the other brim core members that are depicted in the drawings.

Referring to FIG. 26 wherein the use of a typical one of the slits 365, 366, 367, 368 (namely the slit 365) is illustrated, it will be seen that a central portion 735 of fabric (used in defining a crown of the hat 700) connects (in the vicinity of the inner peripheral region 221 of the brim core member 220) with a first reach 781 of the fabric which extends outwardly to cover the bottom or underside of the brim core member 220. A second reach 782 connects with the first reach and extends upwardly to wrap the outer periphery 222 of the brim core member 220. A third reach 783 connects with the third reach and extends inwardly to the inner peripheral region 221. A fourth reach 784 then extends downwardly through the slit 365, and inwardly to a point where it can extend upwardly through the slit 331—which provides a way of gripping or retainingly engaging the fourth reach 784 at the region of the inner periphery 221 to hold the fourth reach 784 securely in position to maintain the stability of the hat 700 even when a slick fabric such as silk or satin is used to cover portions of the hat 700.

Referring to FIG. 26, the fourth reach 784 can then be passed downwardly around the innermost border of the inner periphery 221 (in the manner described earlier herein), with any remaining portions 785 tucked between the first reach 781 and the bottom surface of the brim core member 220; and/or, referring to FIG. 27, selected portions 786 of the fourth reach 784 can be used in the vicinity of the inner periphery 221 to further enhance the appearance of the resulting hat 800 (i.e., the hat 800 is identical to the hat 700 except for the addition of the upstanding decorative fabric portions 786 thereto).

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended to protect whatever features of patentable novelty exist in the invention disclosed.

What is claimed is:

1. A hat formed in situ on a head for one-time wearing, comprising:

a) fabric means for being draped over the head in a manner that permits a central portion of the fabric means to cover at least a major part of a crown of the head while peripheral portions that are connected to and surround the central portion drape downwardly from a bottom portion of the crown of the head to extend about lower portions of the head;

b) means for defining a generally annular brim core member having an inner periphery that is adapted to extend about the bottom portion of the crown when the fabric means is draped over the head in said manner, having an outer periphery, and having a reach of relatively stiff material that extends outwardly away from the inner periphery to the outer periphery to space the outer periphery from the inner periphery, with the reach of relatively stiff material having opposite sides that define an upper surface of the brim core member and a lower surface of the brim core member; and, c) wherein the hat has a crown that is defined at least in part by the central portion of the fabric means covering at least said major part of the crown of the head, and a brim that is formed by wrapping the peripheral portions of the fabric means about the brim core member when the inner periphery of the brim core member extends about the bottom portion of the crown, wherein a first reach of the peripheral portions that is connected to the central portion extends outwardly from the inner periphery to the outer periphery to cover the bottom surface of the brim core member, a second reach connected to the first reach extends upwardly to cover the outer periphery, a third reach connected to the second reach extends inwardly from the outer periphery to the inner periphery to cover the top surface of the brim core member, and a fourth reach connected to the third reach is retainingly engaged at the inner periphery.

2. The hat of claim 1 wherein retaining engagement of the fourth reach at the inner periphery is established, at least in part, by the fourth reach being tucked downwardly from above the top surface to below the bottom surface at the inner periphery.

3. The hat of claim 1 wherein retaining engagement of the fourth reach at the inner periphery is established, at least in part, by the fourth reach being tucked downwardly through a slot formed in the brim core member in the vicinity of the inner periphery.

4. The hat of claim 1 wherein retaining engagement of the fourth reach at the inner periphery is established, at least in part, by the fourth reach being tucked downwardly between the inner periphery and the central portion, and thence outwardly between the bottom surface of the brim core member and the first reach which covers the bottom surface.

5. The hat of claim 1 wherein the brim core member includes means for rendering the inner periphery of the brim core member more flexible than is the reach of relatively stiff material that extends outwardly away from the inner periphery to the outer periphery.

6. The hat of claim 5 wherein the means for rendering the inner periphery more flexible includes at least one formation that extends along the inner periphery and is connected at spaced locations therealong to the reach of relatively stiff material.

7. The hat of claim 6 wherein the at least one formation includes a length of resilient material.

8. The hat of claim 7 wherein the length of resilient material extends along substantially the full length of the inner periphery and is adapted to bias toward the head such portions of the fabric means as are interposed between the head and the length of resilient material.

9. The hat of claim 1 wherein the inner periphery includes an inner region of the brim core member that has slots formed therethrough, and wherein retaining engagement of the fourth reach at the inner periphery is established by the fourth reach being tucked downwardly through at least one of said slots.

10. The hat of claim 9 wherein said retaining engagement also is established by the fourth reach being tucked upwardly through another of said slots after being tucked downwardly through said at least one of said slots.

11. The hat of claim 1 wherein the inner periphery of the brim core member includes at least one formation that projects inwardly toward the head to extend toward the head such portions of the fabric means as are interposed between the head and the at least one formation.

12. The hat of claim 11 wherein the at least one formation includes a plurality of formations that project inwardly toward the head at locations spaced along the length of the inner periphery.

13. The hat of claim 1 wherein the brim core member includes an element cut from a flat sheet of relatively stiff material that forms at least said reach of relatively stiff material that extends outwardly away from the inner periphery to the outer periphery.

14. The hat of claim 13 wherein the brim core member also includes means for giving the inner periphery more flexibility than is exhibited by the flat sheet of relatively stiff material from which said element is cut.

15. The hat of claim 13 wherein said element is generally annular in shape and is provided with a radially extending cut located between two end portions thereof, and said element is given a three dimensional shape by overlapping and bonding together the two end portions to provide at least a component of the brim core member that has a three dimensional configuration.

16. The hat of claim 1 wherein a crown form member is positioned atop the crown of the head before the central portion of the fabric means is draped over the crown of the head, so that the resulting hat has an appearance that is modified by the presence of the crown form member atop the crown of the head.

17. The hat of claim 1 wherein a plurality of pieces of fabric comprise the fabric means.

18. The hat of claim 1 wherein at least two pieces of fabric comprise the fabric means, with a first of the two pieces of fabric serving to cover the crown of the head and to be wrapped about the brim core member to give a desired appearance to the brim of the hat, and with a second of the two pieces of fabric covering such portions of the first piece of fabric as cover the crown of the head to give a desired appearance to the crown of the hat.

19. A hat, comprising:

a) a relatively stiff yet pliable generally annular brim core member formed at least in large part from relatively thin material and having an inner periphery, an outer periphery, and oppositely facing upper and lower surfaces that extend between the inner and outer peripheries, wherein the inner periphery is adapted to extend perimetrically about a lower part of a crown of a head of a person who is to wear the hat; and, b) a piece of flexible cover fabric having a central portion adapted to cover at least a large part of the crown of the head of said person, and having a peripheral portion that extends about the central portion and is adapted to cover the brim core member when the brim core member is positioned to extend perimetrically about the lower part of the crown of the head of said person at a time when the central portion is covering at least said large part of the crown of the head of said person, wherein the peripheral portion has a first part that connects with and extends outwardly from the central portion to cover the lower surface, a second part that connects with the first part and extends upwardly to cover the outer periphery, a third part that connects with the second part and extends inwardly from the outer periphery to cover the upper surface, and a fourth part that connects with the third part and extends downwardly in the region of the inner periphery.

20. The hat of claim 19 wherein a remainder of the peripheral portion is tucked between the lower surface and the first part.

21. The hat of claim 19 additionally including means for enhancing the flexibility of the brim core member in the vicinity of the inner periphery thereof.

22. The hat of claim 21 wherein the means for enhancing flexibility includes means for defining the inner periphery, which means is attached to other portions of the brim core member at locations spaced along the length of the inner periphery.

23. The hat of claim 22 wherein the means for defining the inner periphery includes narrow reaches of the relatively thin material from which the brim core member is formed having selected end portions thereof connected to said other portions of the brim core member.

24. The hat of claim 22 wherein the means for defining the inner periphery includes a resilient band of material adapted to extend perimetrically about the lower part of the crown of the head of said person, and means for connecting the resilient band to said other portions of the brim core member at spaced locations along the length of the inner periphery.

25. The hat of claim 21 wherein the means for enhancing flexibility includes at least one slit formed through at least one selected portion of the brim core member located near the inner periphery.

26. The hat of claim 25 wherein the at least one slit includes a plurality of slits formed through the brim core member at locations spaced along the length of the inner periphery.

27. The hat of claim 19 wherein the inner periphery of the brim core member defines at least one inwardly projecting portion adapted to engage the head of said person to assist in retaining the hat on the head of said person.

28. A method of forming a hat in situ on a head for one-time wearing, comprising the steps of:

a) providing fabric means for being draped over the head in a manner that permits a central portion of the fabric means to cover at least a major part of a crown of the head while peripheral portions that are connected to and surround the central portion drape downwardly from a bottom portion of the crown of the head to extend about lower portions of the head;

b) providing means for defining a generally annular brim core member having an inner periphery that is adapted to extend about the bottom portion of the crown when the fabric means is draped over the head in said manner, having an outer periphery, and having a reach of relatively stiff material that extends outwardly away from the inner periphery to the outer periphery to space the outer periphery from the inner periphery, with the reach of relatively stiff material having opposite sides that define an upper surface of the brim core member and a lower surface of the brim core member; and, c) draping the fabric means over the head in said manner so that the central portion covering at least a major part of the crown of the head serves at least in part to define a crown of the hat, positioning the brim core member to extend about the bottom portion of the crown when the fabric means is draped over the head in said manner, and wrapping the peripheral portions of the fabric means about the brim core member to form a brim of the hat, wherein a first reach of the peripheral portions that is connected to the central portion extends outwardly from the inner periphery to the outer periphery to cover the bottom surface of the brim core member, a second reach connected to the first reach extends upwardly to cover the outer periphery, a third reach connected to the second reach extends inwardly from the outer periphery to the inner periphery to cover the top surface of the brim core member, and retaining engagement is established between the inner periphery and a fourth reach that is connected to the third reach.

29. The method of claim 28 wherein the step of establishing retaining engagement between the inner periphery and the fourth reach includes the step of tucking the fourth reach downwardly in a region of the inner periphery from above the top surface to below the bottom surface.

30. The method of claim 29 wherein the step of establishing a connection also includes the step of causing a remainder portion of the fourth reach to extend outwardly between the bottom surface and the first reach.

31. The method of claim 28 wherein the step of providing the brim core member includes the step of providing means for rendering the inner periphery of the brim core member more flexible than is the reach of relatively stiff material that extends outwardly away from the inner periphery to the outer periphery.

32. The method of claim 31 wherein the step of providing means for rendering the inner periphery more flexible includes the step of providing at least one formation that extends along the inner periphery and is connected at spaced locations therealong to the reach of relatively stiff material.

33. The method of claim 32 wherein the step of providing at least one formation includes the step of providing a length of resilient material to define the at least one formation.

34. The method of claim 33 wherein the step of providing a length of resilient material includes the step of providing the length of resilient material to extend along substantially the full length of the inner periphery in a manner adapted to bias toward the head such portions of the fabric means as are interposed between the head and the length of resilient material.

35. The method of claim 28 wherein the step of providing the brim core member includes the step of providing the inner periphery of the brim core member with at least one formation that biases inwardly toward the head such portions of the fabric means as are interposed between the head and the at least one formation.

36. The method of claim 35 wherein the step of providing the at least one formation includes the step of providing a plurality of formations that project inwardly toward the head at locations spaced along the length of the inner periphery.

37. The method of claim 36 wherein the step of providing the brim core member includes the step of cutting an element of the brim core member from a flat sheet of relatively stiff material to define said reach of relatively stiff material that extends outwardly away from the inner periphery to the outer periphery.

38. The method of claim 37 wherein the step of providing the brim core member also includes the step of providing means for giving the inner periphery more flexibility than is exhibited by the flat sheet of relatively stiff material from which said element is cut.

39. The method of claim 38 wherein the step of providing the brim core member also includes the step of providing said element with a generally annular shape having a radially extending cut located between two end portions thereof, and the step of giving said element a three dimensional shape by overlapping and bonding together the two end portions to provide at least a component of the brim core member that has a three dimensional configuration.

40. The method of claim 28 additionally including the step of providing a crown form member positioned atop the crown of the head before the central portion of the fabric means is draped over the crown of the head, so that the resulting hat has an appearance that is modified by the presence of the crown form member atop the crown of the head.

41. The method of claim 28 wherein a plurality of pieces of fabric are utilized to comprise the fabric means.

42. The method of claim 41 wherein at least two pieces of fabric are utilized to comprise the fabric means, with a first of the two pieces of fabric serving to cover the crown of the head and to be wrapped about the brim core member to give a desired appearance to the brim of the hat, and with a second of the two pieces of fabric covering such portions of the first piece of fabric as cover the crown of the head to give a desired appearance to the crown of the hat.

43. A method of forming a hat, comprising the steps of:

a) providing an annular brim core member configured to extend perimetrically about a base of a crown portion of a head of a person who is to wear the hat, wherein the annular hat brim core member has an inner periphery and an outer periphery that are interconnected by opposed top and bottom surfaces of a reach of material that extends between the inner and outer peripheries;

b) providing flexible fabric material having a central portion of sufficient size to cover at least a large part of crown portion of the head of the person who is to wear the hat, and having a peripheral portion of sufficient size to extend perimetrically about the central portion to cover exterior surface portions of the hat brim core member when the hat brim core member is positioned to extend perimetrically about a lower part of the central portion;

c) forming the central portion of the flexible fabric material to define a configuration that conforms to the shape of and can serve as a cover for at least said large part of the crown portion of the head of the person who is to wear the hat, with the peripheral portion depending from the lower part thereof;

d) positioning the brim core member to extend perimetrically about the lower part of the central portion; and, e) wrapping the peripheral portion of the flexible fabric material outwardly across the bottom surface, upwardly across the outer periphery, inwardly across the top surface, and downwardly in the region of the inner periphery, in that order.

44. The method of claim 38 wherein the step of providing the annular brim core member includes the step of providing the annular brim core member with interior portions that render a region of the inner periphery more flexible and resilient than are other portions of the annular brim core member.

* * * * *